United States Patent [19]

Davis et al.

[11] Patent Number: 4,982,585

[45] Date of Patent: Jan. 8, 1991

[54] TIMER FOR BANK VAULTS

[75] Inventors: Orin H. Davis, Phoenix, Ariz.; John J. Contus, California City, Calif.

[73] Assignee: Miss D, Inc., Phoenix, Ariz.

[21] Appl. No.: 517,938

[22] Filed: May 2, 1990

[51] Int. Cl.[5] ..... E05B 43/00

[52] U.S. Cl. ..... 70/269; 70/271

[58] Field of Search ..... 70/267, 268, 269, 271, 70/272–274

[56] References Cited

U.S. PATENT DOCUMENTS

| | | | |
|---|---|---|---|
| 4,062,210 | 12/1977 | Uyeda | 70/272 |
| 4,137,738 | 2/1979 | Marold | 70/274 |
| 4,359,883 | 11/1982 | Bechtiger | 70/269 |
| 4,643,010 | 2/1987 | Krivec | 70/272 |
| 4,649,833 | 3/1987 | Cummins | 70/268 |

*Primary Examiner*—Robert L. Wolfe

*Attorney, Agent, or Firm*—Cahill, Sutton & Thomas

[57] ABSTRACT

A low current drain timer for bank vaults is easily settable to limit opening of the vault to a predetermined time, irrespective of the time of closing the vault. Three thumb wheels having corresponding indicia are set to designate the elapsed time necessary for reopening. A timer is activated by a reset switch and the manual repositioning of a mechanical latch, which latch permits later closure of a vault door. Either of sequentially operating solenoids at the lapsed time permit opening of the vault door. A backup battery power source renders the timer unaffected by failure of a conventional electrical power source.

40 Claims, 6 Drawing Sheets

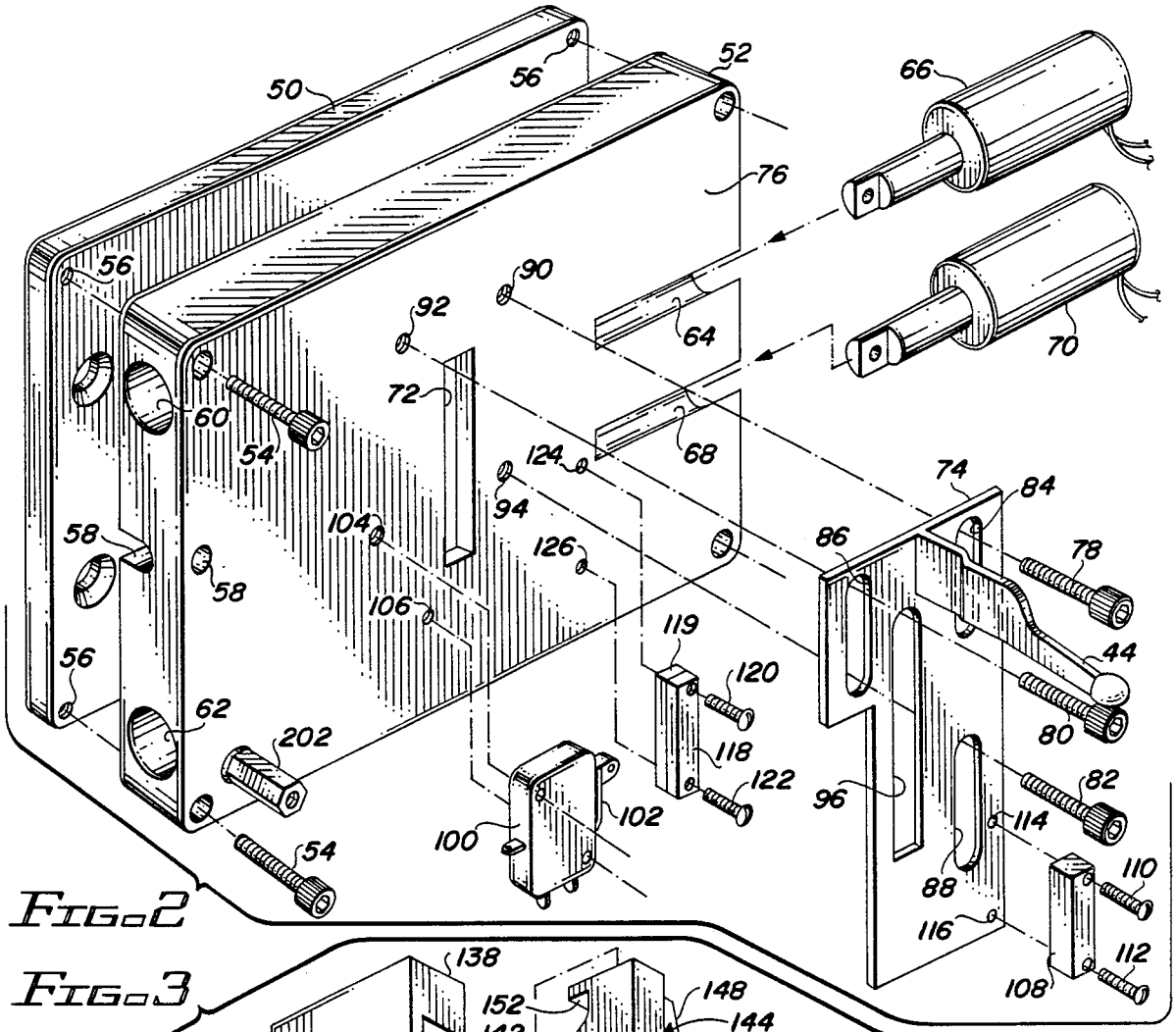
FIG. 2
FIG. 3
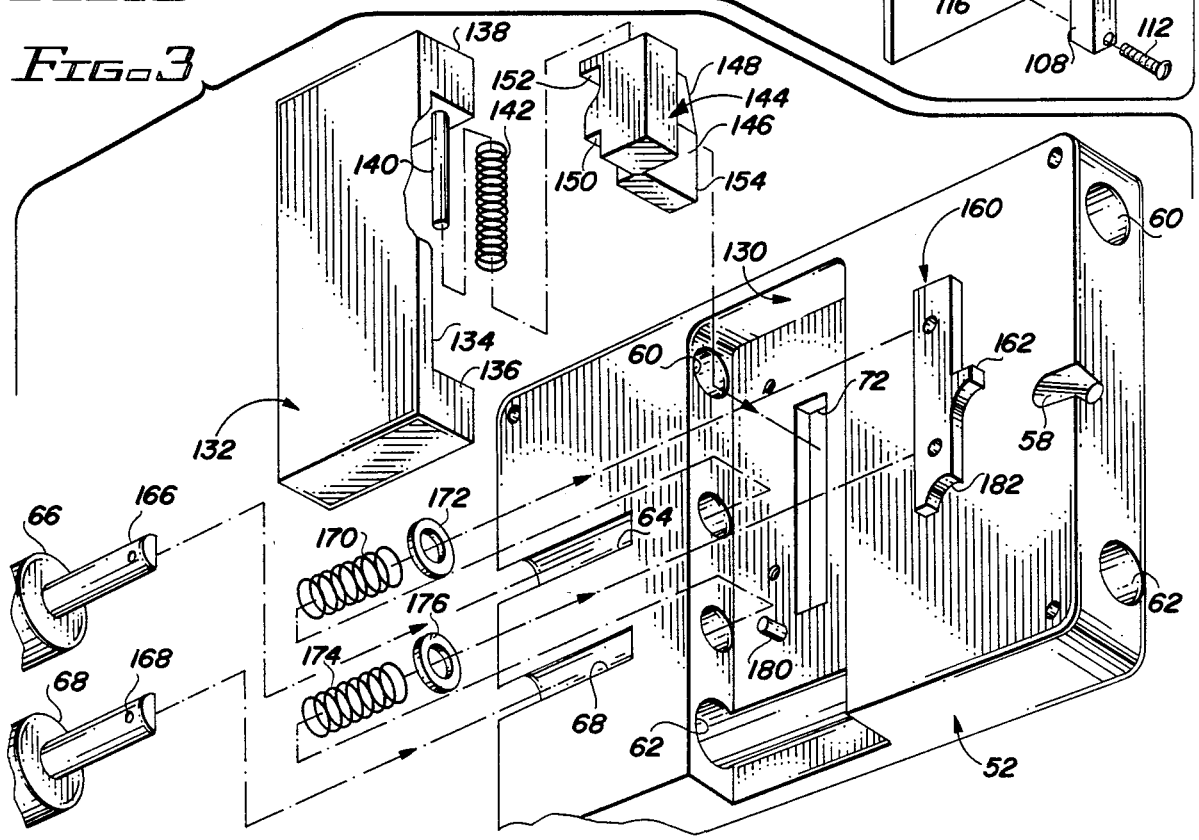

TIMER FOR BANK VAULTS

BACKGROUND OF THE INVENTION

1. Field of the Invention

The present invention relates to time locks for bank vaults and, more particularly, to a low current drain battery operable timer for releasing a gravity operated mechanical block.

2. Description of the Prior Art

For decades, mechanical timers have been employed as time locks for bank vaults. Such mechanical timers must be accurate despite environmental changes and wear. To eliminate wear as a variable, substantial maintenance has been required. The setting of mechanical time locks is generally complicated and missetting often occurs.

Various electrically operated time locks can be used but the power consumption is relatively high. With high power consumption, battery power becomes a predominant problem for long term settings. Reliance upon a source of alternating current from conventional power sources or backup generators will not satisfy criteria for good practice.

Electromechanical time locks for bank vaults generally suffer from all of the wear and maintenance problems attendant mechanical locks and generally have high power requirements. While the electrical timers in electromechanical locks are generally sufficiently accurate, the mechanics activated to lock and unlock a bank vault require high tolerances subject to malfunction due to contamination or are easily detuned to the state of inoperability and require meticulous adjustments.

SUMMARY OF THE INVENTION

A gravity operated vertically rectilinearly translatable block is positionable in a relaxed position to permit opening of a bank vault door. Upon setting of the timer, an upwardly directed spring bias is imposed upon the block to raise the block to a raised position which position inhibits translation or repositioning of a bar; such repositioning is necessary to open the vault door. Actual upward translation of the block will occur in response to spring bias only after the timing mechanism has been previously set and upon closing of the vault door. A timing mechanism includes a crystal oscillator for generating a stream of pulses at a predetermined frequency. After division, the pulses are counted by units, decades and hundreds and produce outputs to an input to each of corresponding comparators. Settable thumb wheels are adjusted to provide a visual indication of the time lock period and provide a further input to each of the comparators. Upon correspondence at the comparators of the counted inputs with the set inputs, an output signal is generated to actuate electromagnetic devices for releasing the block and permit the block to drop by force of gravity to its relaxed position. Thereafter, the vault door may be opened. Failsafe means are incorporated to eliminate the possibility of generating a false output signal due to electronic component failure. The low battery drain of the timer permits use of conventional batteries as power sources. Various indicators are provided to reflect the status of various of the components.

It is therefore a primary object of the present invention to provide a fail safe time lock for a bank vault door.

Another object of the present invention is to provide a gravity operated mechanical release for permitting opening of a bank vault door upon lapse of a predetermined time period.

Yet another object of the present invention is to provide a time lock for a bank vault door settable by translation of a single lever.

Still another object of the present invention is to provide a time lock for a bank vault door which is settable long prior to closing of the vault door.

A further object of the present invention is to provide an electronic timer for comparing the number of pulses in a pulse train with an electrical input generated by time indicating thumb wheels in order to generate an output signal for releasing a bank vault time lock.

A still further object of the present invention is to provide a low current drain battery operated timer for releasing a lock block of a bank vault time lock.

A still further object of the present invention is to provide a fail safe timer for precluding inadvertent unlocking of a bank vault time lock due to component failure.

A still further object of the present invention is to provide a method for selectively mechanically locking a bank vault door.

A still further object of the present invention is to provide a method for timing the unlocking of a bank vault time lock.

These and other objects of the present invention will become apparent to those skilled in the art as the description thereof proceeds.

BRIEF DESCRIPTION OF THE DRAWINGS

The present invention may be described with greater clarity and specificity with reference to the following drawings, in which:

FIG. 2 is an exploded isometric view of the front mounted mechanical components;

FIG. 3 is an isometric exploded view of the rear mounted components;

DESCRIPTION OF THE PREFERRED EMBODIMENT

Timers for controlling or regulating the time of opening a bank vault door have been in use for a period of years. These timers are generally activated upon closure of the bank vault door. Often, such a timer must be set to correspond with the time of closing of the bank vault door. This requirement has and will cause problems due to human error and forgetfulness. All bank vault timers have certain mechanical components which are actuated either by mechanical clockwork devices or by electric or electronic counting or timing circuits. Because mechanical devices tend to wear, they must be carefully designed to preclude or minimize inoperability due to such wear. Moreover, the mechanical elements, which are repositionable with respect to one another, must be carefully designed to prevent inadvertent jamming and resulting inoperability; and, the cost of maintenance of these mechanical time locks exceeds one dollar per day.

When electronic circuitry is used to provide a timing function, setting of the time period must be relatively easy, foolproof, and indicated to an operator. Preferably, initiation of the timing cycle should correspond with actuation of a mechanical lock out feature cooperating with the bank vault door. That is, the mechanical lock out feature must not be engagable without a commensurate actuation of the electric or electronic timer. Power failure is always a potential problem at any installation; the electrically energized timer should therefore be capable of automatically switching to a battery power source without jeopardizing the timing function underway in the event the main power source fails.

As there are many types of bank vaults, a timer for a bank vault door should be readily adaptable to be used with any of a plurality of presently available bank vaults. Such universality of use increases the potential market and therefore, with higher sales volume, the costs can be maintained reasonably low. To further enhance a low cost timer, both the mechanical and electrical components must be relatively inexpensive to manufacture and assemble without compromise of quality.

Figure 1:
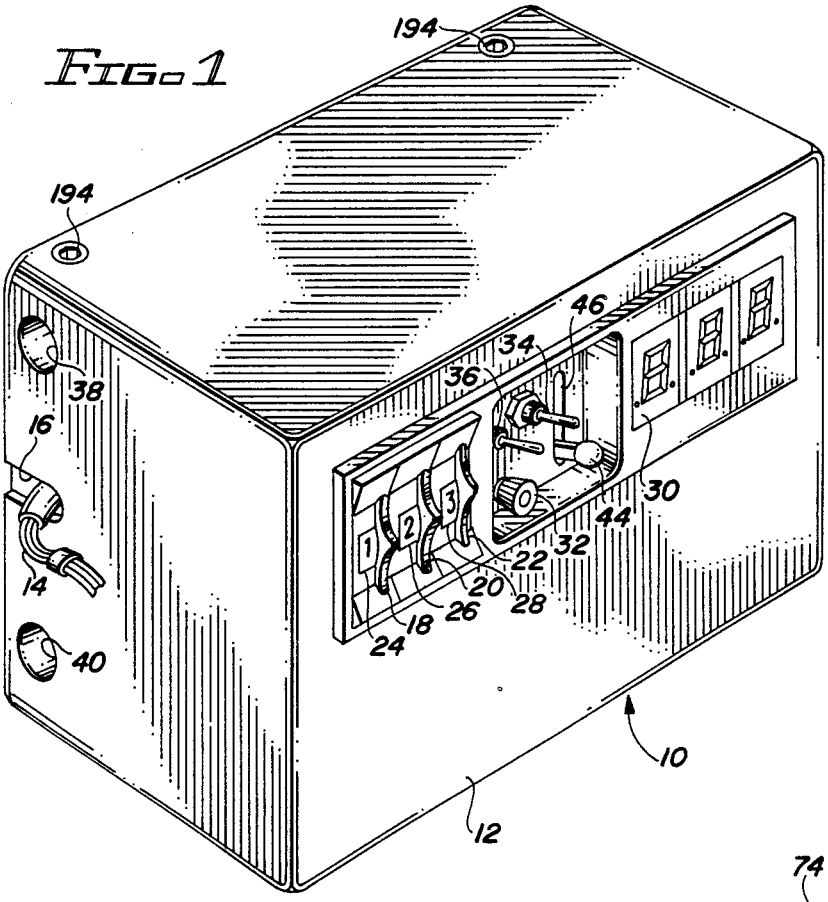
FIG. 1 is a perspective view of the timer.

Referring to FIG. 1, there is shown a bank vault timer 10 having a case 12 for enclosing the operative elements. Electrical power is provided to the timer via electrical conductors 14 entering through a slot 16 in case 12. The face of the case includes thumb wheels 18,20 and 22 having corresponding numerals 24,26 and 28, respectively, to indicate the number of hours that must lapse before a bank vault door can be opened. A display 30 may be incorporated to provide a visual indication of the number of hours remaining before the bank vault door can be opened. Switch 32 is a reset switch. Switch 34 may be incorporated to control operation of display 30. A further switch 36 is a power on/-power off switch.

Most presently used bank vault doors include a rectilinearly translatable rod which translates as a function of locking and unlocking of the door. Depending upon the manufacturer and the door model, this rod may be more or less accessible. Timer 10 includes means (see FIG. 4) for mounting the timer in conjunction with a surface adjacent the translatable rod. Because of different door configurations, the timer may have to be mounted at different elevations with respect to the rod. For this reason, timer 10 may include two ports 38 and 40. Depending upon the mounting position of the timer, the rod will penetrably engage one of these ports. By restricting translation of the rod within timer 10, opening of the door will be precluded. Accordingly, timer 10 operates upon the underlying principle of preventing the requisite translation of the rod to a degree sufficient to prevent opening of the door unless a predetermined time period has elapsed. A further feature of timer 10 permits setting of the timer while the bank vault door is open with the rod in full penetrable engagement with the timer. This latching function is initiated by raising arm 44 extending through vertical slot 46 in case 12. Upon raising arm 44, it will become latched and reset switch 32 will be actuated and the timer will begin to run. The arm will be unlatched when the timer reaches the lapsed time values set on the dials (it may be noted that the time values can be set on the dials before or after reset). Upon closing of the vault door, and partial or full retraction of the rod from within timer 10, repenetration of the rod into the timer will be precluded and the door cannot be opened.

Referring to FIG. 2, there is shown a base plate 50 for attachment to a mounting surface attendant the vault door. A body block 52 is secured to base plate 50 by means of allen head bolts 54 which threadedly engage corresponding cavities 56 in the base plate. The body block includes a passageway 58 for routing conductors 14 therethrough. A cylindrical passageway 60, aligned with port 38, extends through body block 52 for receiving the rod. A similar cylindrical passageway 62 extends from port 40 through the body block. It is to be understood that only one of the cylindrical passageways will in fact be used but by forming two such cylindrical passageways within the body block, timer 10 may be used with differently configured vault doors. A cylindrical cavity 64 is configured to receive and mountingly support solenoid 66. A similar cylindrical cavity 68 mountingly supports solenoid 70. A slot 72 extends transversely through body block 52. A plate 74 is slidably attached to face 76 of body block 52 by allen head bolts 78,80 and 82 penetrably engaging slots 84,86 and 88 in the plate and threadedly engaging threaded cavities 90,92 and 94, respectively. A slot 96 in plate 74 is superimposed with slot 72 in body block 52 upon mounting of the plate. A miniature switch 100, having an actuating roller arm 102, is mounted upon body block 52 with bolts extending through the switch into threaded engagement with threaded cavities 104,106. A bar magnet 108 is mounted upon plate 74 by bolts 110,112 engaging threaded cavities 114,116. A pair of magnetic switches 118,119 are secured to body block 52 by bolts 120,122 engaging threaded cavities 124,126. Switches 118,119 are magnetically switched closed in response to the proximity of magnet 108 when plate 74 is raised. These switches, when closed, energize lighted displays to indicate AC and DC power availability status, respectively.

Referring to FIG. 3, the structure attendant the rear side of body block 52 will be described. A rectangular shaped recess 130 is formed in body block 52 to slidably receive lock block 132. The lock block is of a thickness commensurate with the depth of recess 130. Moreover, the lock block is of a length less than that of the recess to permit and accommodate longitudinal translation of the lock block within the recess. The lock block includes a central plate 134 having rectangular block members 136,138 disposed at opposed ends. A post 140 extends downwardly from block member 138 and supports a coil spring 142. A floating cam 144 includes a cavity disposed in the upper surface thereof for translatably receiving post 140. The floating cam includes two distinct elements. A cam element 146 penetrably engages slot 72 in body block 52. The cam element includes an inclined surface 148 for engaging the roller of roller arm 102 extending from switch 100. The floating cam includes a pair of shoulders 150,152 vertically displaced from one another and in general vertical alignment with one another. A latch 160 includes a pawl 162 extending horizontally therefrom. The latch is secured to each of plungers 164,166 of solenoids 66,68. A coil spring 170 may be mounted upon plunger 166 along with a washer 172 to bear against the rear edge of latch 160. A similar coil spring 174 may be mounted upon plunger 168 along with a washer 176 to bear against the rear edge of the latch. A post 180 may be formed in recess 130 to bear against and serve in the manner of a pivot pin in cooperation with curved edge 182 of latch 160.

Figure 4:
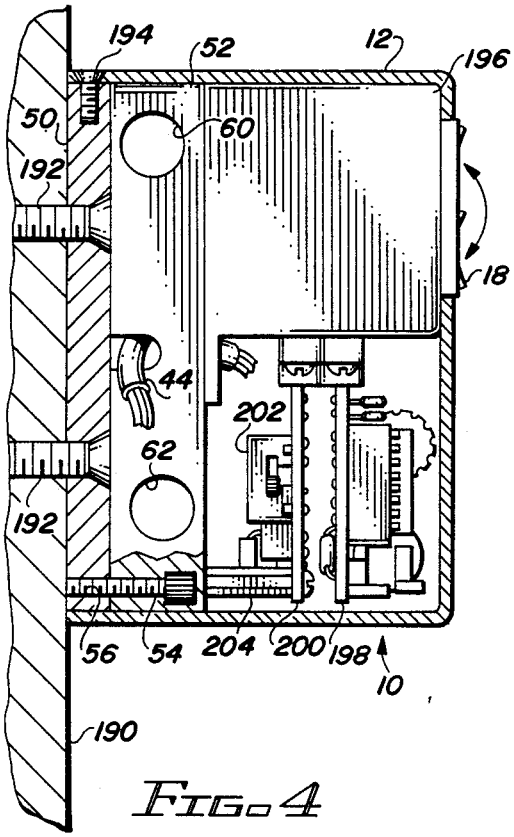
FIG. 4 is a cross sectional view illustrating the location within the case of both the mechanical and electrical components.

Referring to FIG. 4, there is shown a partial cross sectional view of timer 10. Base plate 50 is secured to mounting surface 190 of a bank vault door by means of countersunk mounting bolts 192. Cover 12 is secured to back plate 50 by countersunk bolts 194. The space within cover 12 anterior of body block 52 houses a thumb wheel module 196, of which thumb wheel 18 is partly illustrated. Similarly, a module for display 30 is mounted within the cover on the far side of plate 74 (see FIGS. 1 and 2). The space generally below module 196 and the display module and anteriorly of body block 52 houses circuit boards 198,200 containing various electronic components necessary to perform the timing and display functions. A switch 202, which is not a user accessible switch, is a test switch. It permits accelerated counting from one count per hour to one count per second. Stand offs, such as stand off 204, may be secured to and extend anteriorly from body block 52 to support the circuit boards.

The quiescent and active functions of plate 74 and anteriorly extending arm 44 will be described with joint reference to FIGS. 5A and 5B. To begin the timing cycle, arm 44 (note FIG. 1) is raised along slot 46 and plate 74 will be similarly raised, as indicated by arrow 210. The lower end of slot 96 in plate 74 (see FIG. 3) will bear against the lower edge of cam element 146 of floating cam 144 to raise the floating cam. In the raised position, the floating cam will become latched by engagement of pawl 162 with shoulder 150. Roller arm 102, resting upon inclined surface 148 in the quiescent state, will roll onto surface 154. The arm will pivot toward miniature switch 100 and the state of the switch will change. This switching function will provide a triggering signal to the timing circuit via conductors 212. After the initial upward movement of arm 44, an operator may release the arm. Upon release, plate 74 will drop to its lower position, as depicted by arrow 214. The sliding movement of the plate is accommodated by bolts 78,80 and 82 penetrably engaging slots 84,86 and 88. Upon downward positioning of plate 74, floating cam 144 will remain in the raised and latched position and the resulting relative repositioning between the plate and the floating cam is accommodated by slot 96. Further upward movement of arm 44, with commensurate translation of plate 74, will have no effect upon repositioning of the floating cam.

Upon termination of the timing period, floating cam 144 will become unlatched and it will drop downwardly, which translatory movement is accommodated by slot 96. At the lower position of the floating cam, the roller of roller arm 102 will be transposed from surface 154 to inclined surface 148. The resulting pivotal movement of the roller arm will produce a control signal upon conductors 212. Magnetic switch 108, attached to body block 52, will change state in response to vertical translation of magnet 118 as a result of vertical translation of plate 74. The change in state of magnetic switch 108 is conveyed to circuitry by means of conductors 216.

Figure 6A:
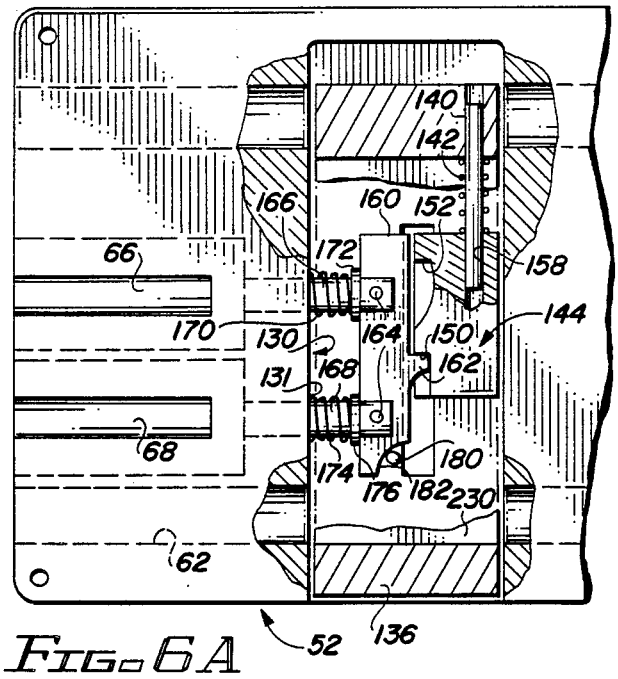
FIG. 6A illustrates the position of the mechanical components subsequent to latching and prior to closure of the vault door.
Figure 6B:
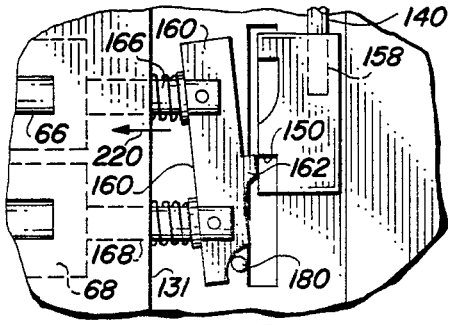
FIG. 6B and 6C illustrate the operation of the mechanical components upon tripping of the latch.
Figure 6C:
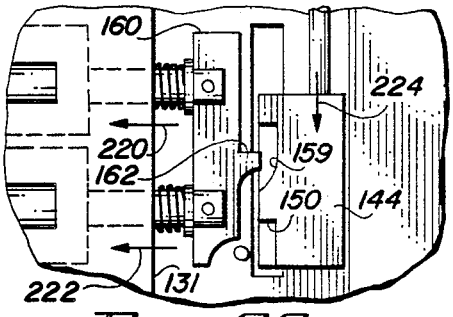

The latching and unlatching of floating cam 144 will be described with joint reference to FIGS. 6A, 6B and 6C, which figures illustrate a posterior view of body block 52. Plunger 166 of solenoid 66 extends into recess 130 to loosely engage the upper end of latch 160 by means of a pin 164. Coil spring 170, bearing against the latch via washer 172, urges the latch away from side wall 131. Upon energization of solenoid 66, plunger 166 is retracted to draw the upper end of latch 160 toward side wall 131. Plunger 168 of solenoid 68 is secured to the lower end of latch 160 by means of a further pin 164. The lower end of the latch is urged away from side wall 131 of recess 130 by coil spring 174 bearing against washer 176 adjacent the latch. Upon energization of solenoid 68, plunger 168 will retract to draw the lower end of latch 160 toward side wall 131. Post 180 loosely supports curved surface 182 of latch 160 and serves in the manner of a pivot point upon retraction of plunger 166.

Figure 5B:
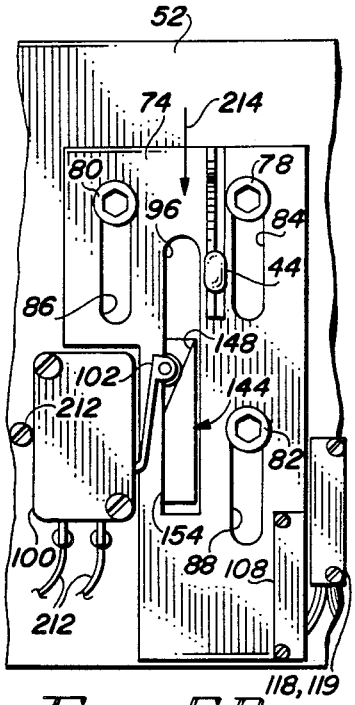
FIG. 5B illustrates the front mechanical components after the timer has tripped.
Figure 5A:
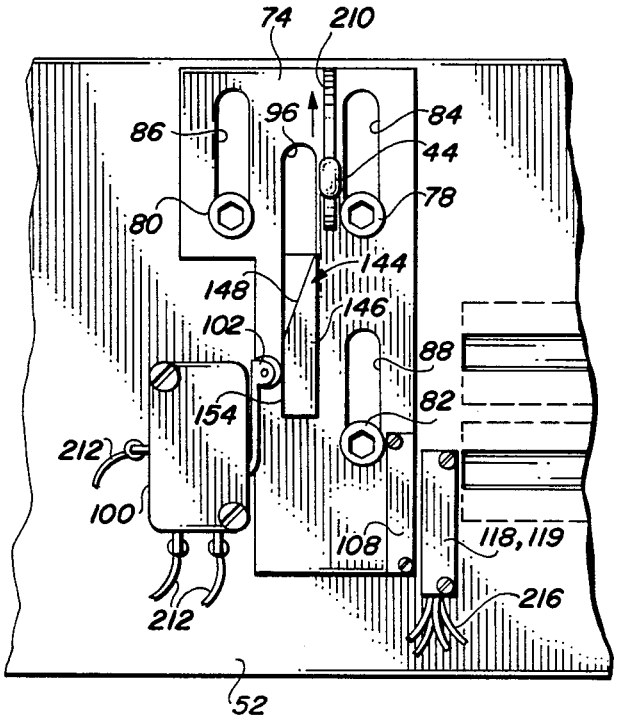
FIG. 5A illustrates the front mechanical components after latching.

Shoulder 152 of floating cam 144 rests upon pawl 162 of latch 160 when the floating cam is in the lower position (as shown in FIG. 5B). When the floating cam is in the raised position (as shown in FIGS. 5A and 6A) shoulder 150 rests upon pawl 162. Upon actuation of either or both of solenoids 66,68, latch 160 will be drawn toward side wall 131. The resulting repositioning of the latch will disengage pawl 162 from shoulder 150. Upon such disengagement, upward support for the floating cam in its raised position is non existent. Floating cam 144 will then drop in response to gravity and in response to the force exerted by coil spring 142 disposed between the floating cam and block 138 of lock block 132. As a guide to vertical translation of the floating cam, post 140 extends into cavity 158 developed in the upper end of the floating cam. This function is more clearly illustrated in FIG. 6B wherein arrow 220 represents retraction of plunger 166 and pawl 162 is shown clear of shoulder 150 to permit the floating cam to drop. Preferably, solenoid 66 is energized slightly prior to energization of solenoid 68 in order to obtain a cocking action of latch 160, as illustrated. The subsequent retraction of plunger 168 as a safety measure in the event solenoid 66 doesn't operate or in the event plunger 166 is not retracted, as particularly illustrated in FIG. 6C and depicted by arrow 222, laterally displaces the lower part of the latch to permit downward movement of floating cam 144, as depicted by arrow 224 by drawing latch 162 clear of shoulder 150.

Upon upward movement of arm 44 and accompanying plate 74, the floating cam will be raised, as discussed above. The upward translation of the floating cam will cause curved surface 159, upwardly of shoulder 150, to bear against the lower edge of pawl 162 of latch 160 and cause translation of the latch toward side wall 131. Such translation will permit passage of shoulder 150 past pawl 162. Upon such passage of shoulder 150, latch 160 will be forced away from sidewall 131 by coil springs 170,174.

Figure 8:
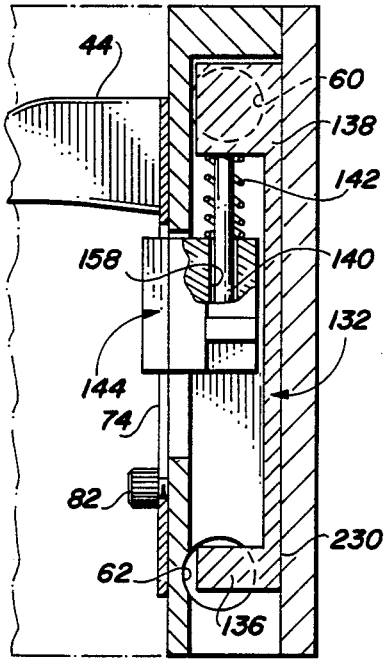
FIG. 8 illustrates the position of the mechanical components after latching and closure of the vault door.
Figure 7:
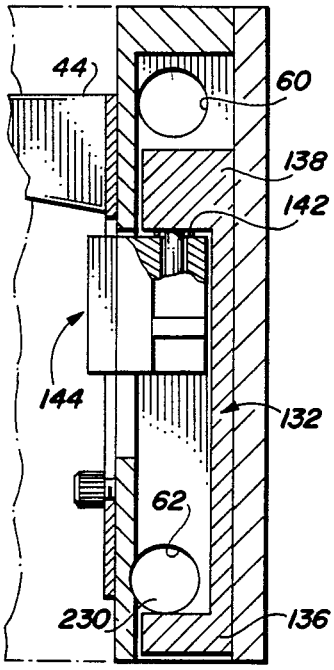
FIG. 7 is a partial cross sectional view illustrating the position of the mechanical components subsequent to latching and prior to closure of the vault door.

A bank vault door includes a rod 230 which translates linearly in response to locking and unlocking of the door lock mechanism. Such rod is depicted in FIGS. 6A, 7, 8 and 9. In the embodiment illustrated, rod 230 extends into cylindrical passageway 62. When the vault door is open, rod 230, disposed within cylindrical passageway 62, extends across recess 130 (as depicted in FIG. 6A). To accommodate this position of the rod, block member 136 of lock block 132 is dimensioned and positioned beneath rod 230, as shown in FIG. 7. The interference between block member 136 and the rod precludes upward movement of lock block 132. Nevertheless, for reasons described with respect to FIGS. 6A, and 6B and 6C, floating cam 144 is free to translate upwardly and downwardly without commensurate movement of the lock block. Upon retraction of rod 230, which will occur upon closing of the vault door, rod 230 is translatably repositioned out of recess 130. With such withdrawal of the rod, it will no longer interfere with block member 136. Accordingly, lock block 132 is free to be raised. In the raised position, as depicted in FIG. 8, block member 136 is positioned in general alignment with cylindrical passageway 62 and will effectively preclude translation of rod 230 into recess 130 in body block 52. Without such translation of rod 230, the vault door cannot be opened.

Upon upward translation of floating cam 144 and locking it in place by engagement of pawl 162 with shoulder 150, coil spring 142 will be compressed. The compressed coil spring will exert an upward force upon block member 138 of lock block 132 and urge upward movement of the lock block and it will be raised, as discussed above.

Figure 9:
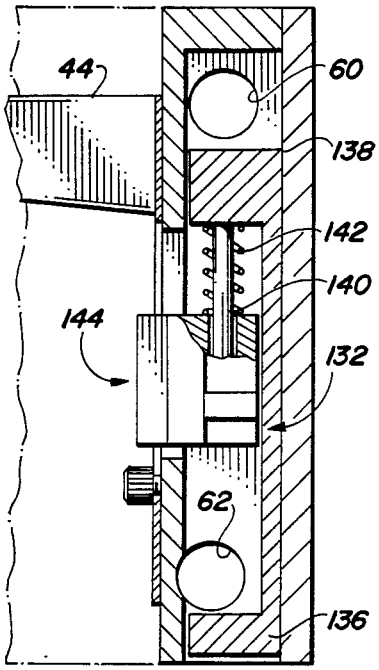
FIG. 9 illustrates the position of the mechanical components prior to latching and while the vault door is open.

On completion of the time interval set by timer 10, solenoids 66,68 will be energized to retract the respective plungers. The act of retracting the plungers will reposition latch 160 to permit floating cam 144 to drop. The resulting lowered position of the floating cam, as depicted in FIG. 9, will permit extension of coil spring 142 and remove the upward urging bias against block member 138. Accordingly, lock block 132 will drop to the position depicted in FIG. 9. The dropped lock block will reposition block member 136 to a point out of alignment with cylindrical passageway 62. Thereafter, rod 230 may be translated along the cylindrical passageway and through recess 130.

In certain applications, it may be preferable to locate timer 10 such that cylindrical passageway 60 receives rod 230 of the vault door. In such event, the above described procedure would be duplicated except that block member 138 would serve the functions of restricting and accommodating passage of rod 230 within cylindrical passageway 60 across recess 130.

As alluded to above, timer 10 can be set by actuating reset switch 32 and upward movement of arm 44 with the door open. Such upward movement will latch floating cam 144 in its upper position. However, because of interference between rod 230 and block member 136, the lock block will not be reset. Nevertheless, the timing function will have been triggered and the time period would be counting. Upon closing of the vault door, the retraction of rod 230 would remove the restraint against block member 136 and the lock block would rise to block further penetration of rod 230 into recess 130. Thus, the setting of timer 10 can be effected long before it is time to close the vault door and the timing function will be under way even while the vault door is open and the vault is in use.

Figure 10A:
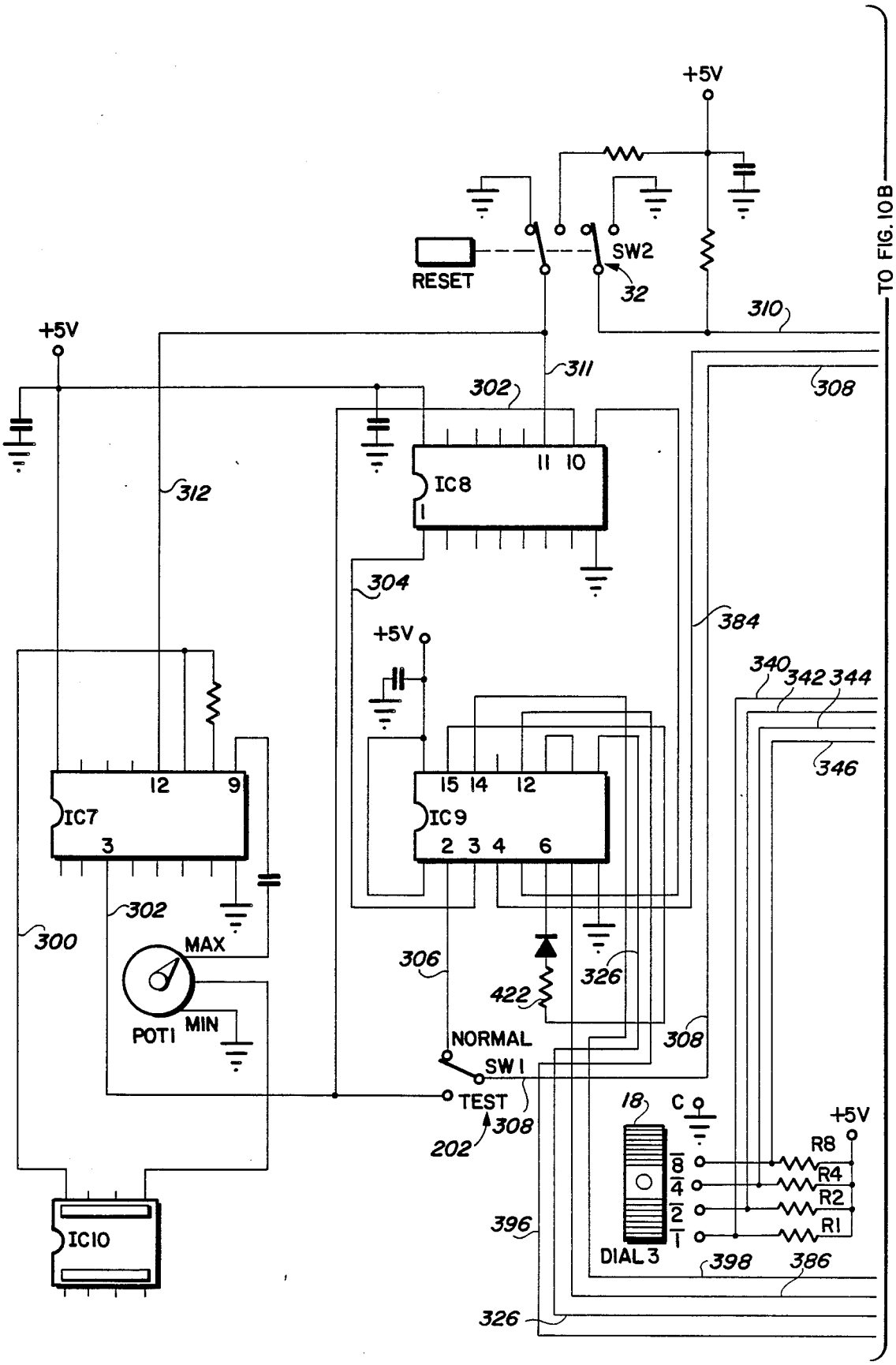
FIGS. 10A, 10B and 10C illustrate the electronic timer circuitry.
Figure 10B:
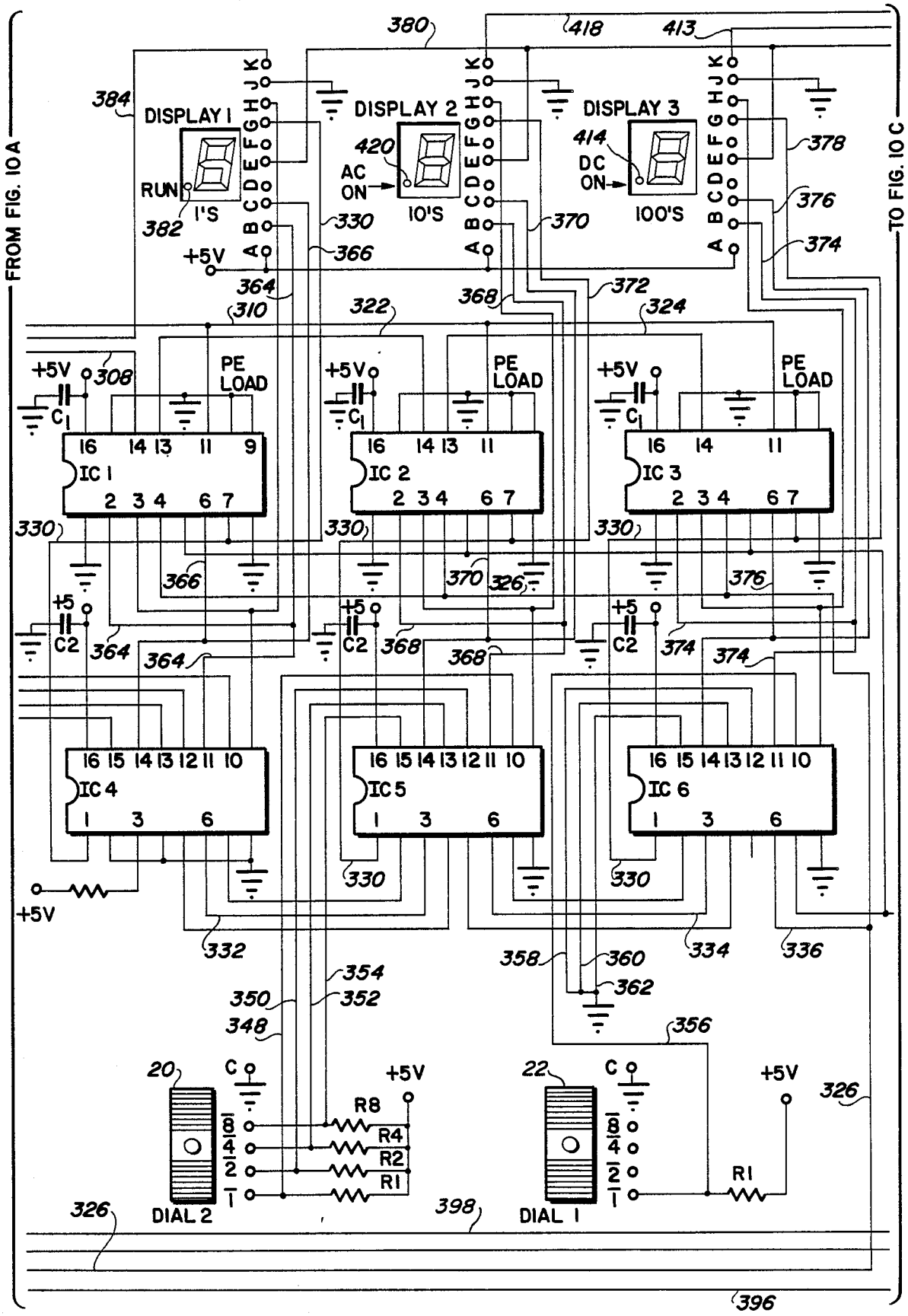
Figure 10C:
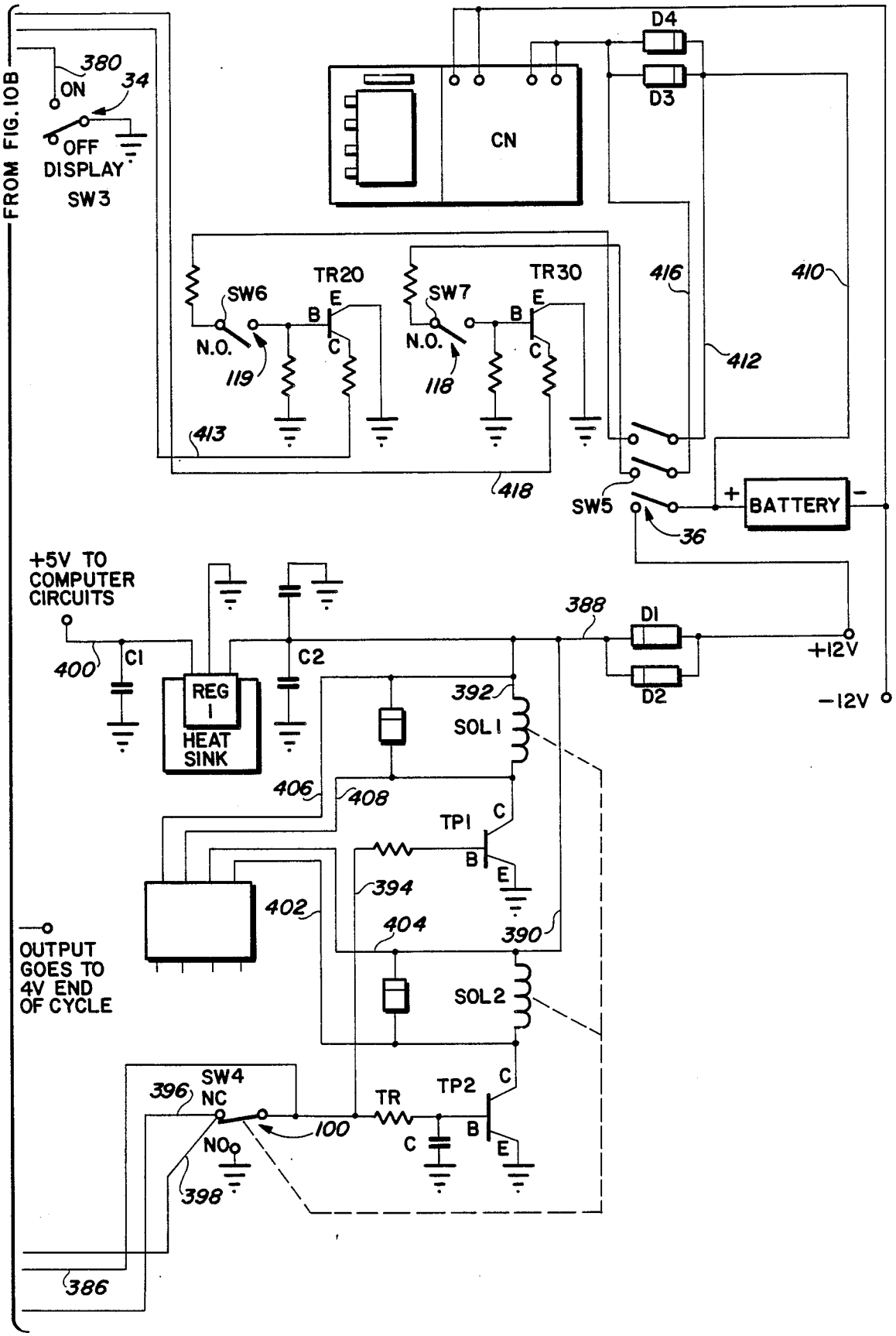

The countdown timer circuit for actuating the latch to release the lock block and permit opening of a bank vault door will be described with joint reference to FIGS. 10A, 10B and 10C. Before proceeding with a detailed description of the circuit, it may be beneficial to provide an overview of the function of the major sections. The timer circuit is a three digit timer that counts up to 199 hours. It requires a very low current while maintaining adequate accuracy and provides ease of operation. The elapsed time is set by three thumb wheels. Thereafter, actuating the reset button will start the count at zero and continue the count until the preset time is reached. A signal is generated on completion of the time period to energize the solenoids and actuate the latch to permit the lock block to drop out of interfering relationship with the bank vault door rod. The total current drain of timer 10 is approximately 250 milliamps. This low current drain provides, from a widely available commercial battery, 63 hours of operation without charge. These figures compare favorably with other timing circuits drawing approximately 3 amps per hour.

Because it may be useful to obtain an overview of the timer prior to a discussion of the individual components and their discrete functions, the following synopsis is presented. Comparators IC4, IC5 and IC6 form the heart of the timer. Upon agreement between the twelve inputs from the three counters, IC1, IC2 and IC3, with the twelve inputs from the three thumb wheel switches, as determined by comparators IC4, IC5 and IC6, the output of comparator IC6 goes high. The pulse generated by comparator IC6 terminates the operation of the timer. That is, the output of the comparator increases from 0.3 volts to approximately 2.5 volts. This pulse is transmitted along conductors 336 and 326 to pins 4 of counters IC1, IC2 and IC3 to inhibit further counting. Simultaneously, the pulse is transmitted along conductor 386 to Darlington transistors TP1 and TP2 to initiate opening of the vault door.

More particularly, three up/down digital counters, IC1, IC2 and IC3, are driven by precision crystal oscillator IC10 and CMOS multivibrator IC7 having two invertor circuits and a divider and providing an output frequency of 1.20058 Hz. IC8 counts down from 1.20058 Hz to 1 Hz per hour; additionally, it generates a 1+ Hz output signal to display active operation of the system. Counters IC1, IC2 and IC3 may be of the type known as 74LS190. The output of the counters is applied to three four-bit comparators, IC4, IC5, IC6, which may be of the type known as 74LS85. The three thumb wheels provide an input to the three comparators in a binary coded decimal mode. Once the input number is applied and the reset switch actuated, the counters will count up from zero to the number corresponding with the input from the respective thumb wheel switch. The last comparator generates a stop pulse. The stop pulse energizes a Darlington amplifier (TP1) which provides the requisite current to operate one of the solenoids. A slight time delay will occur before a second Darlington amplifier (TP2) is energized to operate the second solenoid. A regulated 5 volt DC current is provided by a regulator (REG 1), of a type known as 7805, to all counter circuits. Various further features are included, such as reverse voltage protection, noise suppression, failsafe feature security override. The latter is an XY matrix whereby two individuals can provide data to generate an output signal to actuate the solenoids in the event of circuit failure. An on/off switch SW3 (34) is provided for turning off the display when not needed to conserve power. Isolation against reverse polarity of the power source and compensation for failure of a conventional AC power supply is provided.

Thumb wheels 18,20 and 22 provide a voltage output reflective of a specific number from 0 to 9. These thumb wheels, or number generators, permit entry in parallel, rather than serially, of the number of hours to be made. This feature substantially eases and simplifies operation of the timer to an operator. A crystal oscillator, IC10, is a precision crystal oscillator to provide sufficient accuracy to meet the tight time schedules of a bank. The crystal oscillator generates a precise 18641 Hz signal coupled to IC7 via conductor 300. The function of potentiometer POT1, interconnected between pin 9 of IC7 and crystal IC10, is to provide a potential for variable feedback to accommodate differences in range of sensitivity of crystals which are commercially available. With the use of an oscilloscope or like instrument, the input frequency to IC7 can be readily set very accurately irrespective of variations in the crystals that might be used. IC7 includes internal counters that divide by $2^{16}$ to produce a 1.20058 Hz output signal on conductor 302 at pin 3. Conductor 302 applies the output signal to pin 10 of IC8. The output of IC8 is conveyed via conductor 304 from pin 1 of IC8 to pin 3 of IC9. IC9 contains invertor and driver circuits. The output of IC9 appears at pin 2 and is conveyed via conductor 306 to test switch SW1. The output of switch SW1 (202) is conveyed via conductor 308 to pin 14 of IC1. IC1 is an up/down digital counter. The purpose for test switch SW1 (202) is that of accelerating the timer to compress the time of one hour to one second for test purposes; it is not available to an end user. On throwing the switch, the output signal on pin 3 of IC7 is applied directly to pin 14 of IC1 to bypass the countdown by IC8.

To initiate operation of the timer, all counters (IC1, IC2 and IC3) have to be reset to zero. This function is performed by reset switch SW2 (32), which switch may be a double pole, double throw switch. On actuation, the switch will ground each of pins 11 of IC1, IC2 and IC3, which grounding zeros all internal flip flops. Simultaneously, switch SW2 (32) applies 5 volts to pin 11 of IC8 via conductor 311, which pin is normally grounded through the switch, to zero the counter. Simultaneously, 5 volts is applied to pin 12 of IC7 via conductor 312 to reset the crystal circuit; normally, pin 12 is grounded through switch SW2. Accordingly, a simple push upon the reset switch SW2 (32) eliminates resetting of all individual counters and the work load upon a bank employee is substantially reduced.

The three main counters, IC1, IC2 and IC3 are reversible counters. In the configuration employed, each of them counts up. IC1 counts from zero to 10, IC2 provides a decades count and IC3 provides a hundreds count. IC1 generates a binary code from zero to 9 by providing outputs upon pins 2, 3 and 6. When the count of 9 is reached, a carry is provided at pin 13 and an input signal will appear at pin 14 of IC2 via conductor 322. IC2 will provide an output on pins 2, 3 and 6 in the same manner as IC1. On completion of the count, a carry will generate an output at pin 13 which is conveyed to pin 14 of IC3 via conductor 324. Pins 2, 3 and 6 of IC3 will provide an output in the same manner as discussed with respect to IC1. Pins 4 of each of IC1, IC2 and IC3 are interconnected via conductor 326 and with pin 9 of IC9 and with pin 6 of IC6 via conductor 336. A signal on pin 4 will disable counters IC1, IC2 and IC3. Each of pins 7 of IC1, IC2 and IC3 are connected via conductor 330 to each of pins 1 of IC4, IC5 and IC6 to limit the count to zero to 9 instead of zero to 15. On reaching the count of 9, a resetting function is performed. Similarly, conductor 330 interconnects terminal G of each of displays 1, 2 and 3. These displays are also reset.

A 5 volt regulated power is applied to pins 16 of each of ICs 1, 2, and 3. Because these integrated circuits switch very rapidly, approximately at a 20 megacycle rate, voltage spikes may occur. The function of each of capacitors C1 is that of grounding transient voltage spikes. Similarly, the power applied to pin 16 of each of ICs 4, 5 and 6 is smoothed of transient voltage spikes by capacitors C2.

Pin 3 of IC4 is connected to a 5 volt power supply. It serves the function of limiting the count to zero to 9. IC4 provides an output at pin 6 connected via conductor 332 to pin 3 of IC5 to start the count of IC5 to limit the count of IC5 to zero to 9. IC5 provides an output at pin 6 connected to pin 3 of IC6 via conductor 334 to limit the count of IC6 to a count of zero to 9. Pin 6 of IC6 is connected via conductor 336 to conductor 326, the latter being in electrical communication with pins 4 of IC1, IC2 and IC3. With these connections, all three comparators, IC4, IC5 and IC6, will begin their count at zero. Upon obtaining an output at pin 6 of IC6, an output signal is provided which will ultimately result in termination of the timer and opening of the vault door.

The input to comparator IC4 is provided by dial 3 acting through terminals 1, 2, 4 and 8 to provide a desired numeral. A 5 volt power source, acting through current limiting resistors, R1, R2, R4 and R8, interconnects with terminals 1, 2, 4 and 8 of dial 3 and pins 10, 12 13 and 15 of IC5 via conductors 340,342,344 and 346, respectively. Accordingly, a selected numeral of dial 3 will provide an appropriate signal input to comparator IC4. Dial 2 includes a duplicated capability for providing the equivalent of a numerical input to pins 10,12,13 and 15 via conductors 348,350,352 and 354. By design, comparator IC6 is limited to a single numeral, 1, in order for the timer to provide a maximum output of 199 hours. Accordingly, terminal 1 of dial 1 provides an input to pin 10 of comparator IC6 via conductor 356. Power from a 5 volt source is provided via resistor R1. Pins 12,13 and 15 of IC6 are grounded via conductors 358,360 and 362. Accordingly, manipulation of dials 1, 2 and 3 will generate the proper code to correspond with the number of hours to be counted.

Displays 1, 2 and 3 are seven segment displays for displaying the number of hours remaining during a countdown. Terminal A of each of the displays is connected to a five volt power source. Terminals B, C and G of each display control the segments of the seven segment display which is to be lighted. Comparator IC4 provides an output at pin 11 transmitted to terminal B of display 1 via conductor 364. Pin 14 of IC4 provides an output via conductor 366 to terminal C of display 1. Terminal 1 of IC4 provides an output to terminal G of display 1 via conductor 330. It may be noted that conductor 364 is also tied in with pin 2 of IC1, conductor 366 is tied in with pin 6 of IC1 and conductor 330 is tied in with pin 7 of IC1. Similarly, pin 11 of comparator IC5 is connected to terminal B of display 2 and pin 2 of IC2 via conductor 368. Pin 14 of comparator IC5 provides an output to terminal C of display 2 via conductor 370; this conductor is also connected with pin 6 of IC2. Pin 1 of comparator IC5 is connected to pin 7 of IC2 via conductor 330 and to terminal G of display 2 via conductor 372. Pin 11 of comparator IC6 provides an input to terminal B of display 3 via conductor 374; this conductor is also connected to pin 2 of IC2. Pin 14 of comparator IC6 is connected to terminal C of display 3 via conductor 376 and to terminal 6 of IC3. Terminal 1 of comparator IC6 is connected to pin 7 of IC3 via conductor 330 and to terminal G of display 3 via conductor 378. Terminal E of display 1 is interconnected with terminals E of display 2 and 3 via conductor 380. This conductor is grounded through display switch SW3 to energize the respective segments of displays 1, 2 and 3.

Pin K of display 1 is electrically connected to light emitting element 382 identified by the designation "run". It provides a visual indication to an operator that the oscillator is running and that the unit is ready to be actuated. Pin K is connected to pin 4 of IC9 via conductor 384. Pin 4 of IC9 goes high only when crystal oscillator IC7 and counter IC8 are functioning along with IC9.

Pin 6 of IC6 goes high on completion of the previously set time. The output is conveyed via conductor 336 to conductor 386 to solenoid drive circuits TP1 and TP2. Preferably, TP1 and TP2 are very high gain Darlington transistors in order to generate up to 4 amperes to drive solenoids SOL1 and SOL2. Since the two solenoids are not to be operated simultaneously, but sequentially, a timed delay circuit formed by resistor TR and capacitor C attendant transistor TP2 is employed. This provides a 50–100 millisecond timed delay, depending upon the values of TR (normally 1.47K ohms) and capacitor C. Power for the solenoids is provided from +12 volt source through diodes D1, D2 and conductor 388. Current to the collector of transistor TP1 is provided through conductor 388 and conductor 392 via the coil of solenoid SOL1. Current to solenoid SOL2 is provided via conductor 388 and conductor 390 and to the collector of transistor TP2. Transistor TP1 will conduct upon presence of a signal on conductor 394 and transistor TP2 will conduct after the time delay defined by resistor TR and capacitor C. Switch SW4 (100) is ganged with solenoids SOL1 and SOL2 to switch SW4 (100) from the normally closed to the open (grounded) position. Prior to switching, switch SW4 (100) provides an input from conductor 386 to two conductors 396, 398 connected to pins 12 and 14 of, respectively, an IC9. These inputs will terminate further output of IC9. Light emitting element 422, connected intermediate pins 6 and 15 of IC9, is energized upon application of voltage to pins 12 and 14 of IC 9 as a result of actuation of at least one of solenoids SOL1 and SOL2. More specifically, when switch SW4 is in the normally closed (NC) position, both conductors 386 and 398 are at the same potential (low). When the timer reaches its final value and the solenoids are activated, switch SW4 goes to the normally open (NO) position. This grounds conductor 386 and allows voltage to flow to LED 422. Thereby, a visual indication can be provided that at least one solenoid has been energized and the latch of the timer has been unlatched; however, this indicator is optional.

Regulator REG1 is connected to conductor 388 and provides a 5 volt output on conductor 400 which is connected to the various circuit components, as indicated. Capacitor C2 is incorporated to prevent oscillation of regulator REG1. Capacitor C1 decouples the regulator from ICs 1 to 6; it also provides some current smoothing.

Because there is always the possibility of circuit failure due to any number of causes, it is mandatory that operation of solenoids SOL1 and SOL2 be performable without destruction of timer 10. To achieve this end, a matrix M may be employed. This type of matrix is sometimes referred to as an XY matrix. It requires two inputs, one for the X axis and one for the Y axis individually held by different bank security persons. Each of such two persons would energize his/her respective axis. At the point of intersection, a hole would be drilled which would result in application of a voltage on conductors 402, 404 to energize SOL1 and on conductors 406, 408 to energize SOL2.

A battery BAT is connected to +12 volt supply via 3 pole single throw switch SW5. An available alternating current power source provides power to charging network CN. Coupling diodes D3, D4 provide a trickle charge to battery BAT via conductor 410. Switch SW6 (119) is closed on raising of plate 74 (See FIGS. 2, 5A and 5B). Transistor TR20, connected through switch SW6 (119) switch SW5 (36) and conductor 412 to the output of the coupling diodes, provides an indication on conductor 413 that the charging current is functioning. Conductor 413 is connected to terminal K of display 3. An input signal on terminal K energizes light emitting element 414 to signal that DC power is provided. Switch SW7 (118) is closed on raising plate 74 (See FIGS. 2, 5A and 5B). Transistor TR30 is connected to charger CN via switch SW7 (118), switch SW5 (36) and conductor 416. The output of transistor TR30, conveyed via conductor 418 energizes terminal K of display 2. Terminal K activates light emitting element 420 to indicate that AC power is available. Normally open switch SW6 (119) may be ganged with the display switch, SW3 (34), to energize light emitting element 414 only when the display is lighted. The threshold voltage at the base of transistor TR20 is 0.6 volts, whereby an indication is not provided unless at least a threshold voltage of 0.6 volts is provided at the base electrode of transistor TR20 and a threshold voltage of 0.7 is provided at the base electrode of transistor TR30. Accordingly, when these voltages are exceeded by the battery, or the AC power, respectively, the respective light emitting elements are turned on. (Switch SW5 (36) is also termed the master switch, switch 36. In some installations, master switch SW5 may be elected not to be used in accordance with bank policy to preclude the possibility of an employee inadvertently leaving the switch in the off position.) It may be noted that battery BAT is within the bank vault; therefore, the timer cannot be turned off or otherwise be disconnected without access through the bank vault door.

Although a failure mode is rare for the integrated circuits used in the above described and illustrated timer, inadvertent opening of the bank vault due to a failure of a circuit component would be intolerable and unacceptable. The timer described above precludes a failure of any of the components from causing an unintentional opening of the vault door. This result is assured since a failure of a component will result in, at worst case, a low level signal on any particular conductor or pin. To confirm this conclusion, each of the components will be reviewed with respect to the effect resulting from failure of the component. A failure of the crystal, IC10, or IC7 will curtail further pulses on conductor 307 and pin 3. Without generated pulses, the timer will stop. A failure of IC8 would prevent an output on pin 1 of IC8 and conductor 304 and no further action would occur. Since IC9 is simply an invertor, failure would result in no further action. Failure of any of IC1, IC2 or IC3 would cease propagation of pulses and the timer would stop. A failure of IC4 or IC5 would preclude a voltage or pulse on conductors 332 and 334 and the timing function would cease. Should IC 6 fail, pins 6 and 7 would not provide a high output on conductor 320 and Darlington transistors TP1 and TP2 would not be triggered. Since the twelve inputs on comparators IC4, IC5 and IC6 have to agree with the thumb wheel switches to permit opening of the vault, such agreement cannot occur if any component of the timer fails. Should there be a component failure, the manually operated X-Y matrix would have to be implemented.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A time lock device for a bank vault door having a rectilinearly translating rod, which rod translates as a function of the open and closed position of the vault door, said device comprising in combination:

(a) a body block for receiving the rod when the vault door is in the open position;

(b) a lock block supported by said body block for selectively precluding translation of the rod within the body block, said lock block having a latched position for inhibiting translation of the rod within said lock block and an unlatched position for accommodating translation of the rod within said body block;

(c) mechanical means for positioning said lock block in the latched position;

(d) release means for accommodating repositioning of said lock block into the unlatched position in response to the force of gravity;

(e) a timer for determining the time period after which said release means will be actuated to reposition said lock block to the unlatched position and to permit translation of the rod within said body block to open the vault door;

(f) said timer including a constant frequency source for establishing a train of pulses;

(g) at least one counter responsive to the train of pulses for providing a first output signal as a function of an elapsed time period;

(h) at least one settable number generator for providing a second output signal reflective of the time period to elapse before actuation of said release means;

(i) at least one comparator for receiving and comparing said first and second output signals to provide a third output signal upon comparison between said first and second output signals; and (j) means responsive to said third output signal for actuating said release means upon correspondence between the elapsed time determined by said counter and the set time determined by said generator.

2. The apparatus as set forth in claim 1 wherein said body block includes a passageway for receiving the rod and wherein said lock block blocks said passageway when said lock block is in the latched position to preclude translation of the rod along said passageway.

3. The apparatus as set forth in claim 2 wherein said mechanical positioning means includes means for urging said lock block into the latched position while the rod is disposed within the passageway.

4. The apparatus as set forth in claim 3 including a latch for maintaining said lock block in the latched position upon repositioning of said lock block into the latched position in response to said urging means.

5. The apparatus as set forth in claim 4 wherein said release means includes a solenoid for repositioning said latch to permit said lock block to be repositioned to the unlatched position.

6. The apparatus as set forth in claim 5 wherein said release means includes a pair of said solenoids and wherein said actuating means includes means for serially energizing said pair of solenoids.

7. The apparatus as set forth in claim 6 wherein said mechanical positioning means is manually operated.

8. The apparatus as set forth in claim 1 including means for initiating operation of said timer irrespective of the position of said lock block.

9. The apparatus as set forth in claim 1 including means for initiating operation of said timer and wherein said mechanical positioning means includes means for urging repositioning of said lock block to the latched position upon exercise of said initiating means and prior to translation of the rod within said passageway upon closing of the vault door.

10. The apparatus as set forth in claim 9 wherein said urging means comprises means for augmenting the force of gravity to reposition said lock block from the latched position to the unlatched position.

11. The apparatus as set forth in claim 10 including visually perceivable indicators for reflecting actuation of said mechanical positioning means.

12. The apparatus as set forth in claim 1 including means associated with each of said frequency source, said counter, said generator and said comparator for precluding actuation of said actuating means in the event of malfunction.

13. The apparatus as set forth in claim 1 including over ride means for generating an over ride signal to operate said actuating means in the event of malfunction of said device.

14. The apparatus as set forth in claim 1 including two sources of electrical power and means for energizing said device from one of said two separate sources of electrical power.

15. The apparatus as set forth in claim 1 wherein said counters comprise three counters representative of ones, tens and hundreds of hours, wherein said generators comprise three generators representative of ones, tens and hundreds of hours and wherein said comparators comprise three comparators representative of ones, tens and hundreds of hours.

16. The apparatus as set forth in claim 15 including means for accelerating operation of said counters for test purposes.

17. The apparatus as set forth in claim 15 including means for depicting in visually perceivable format the time status of said counters.

18. The apparatus as set forth in claim 17 including an AC source of power and a DC source of power and means for providing a current flow from one of said AC source and said DC source to said timer.

19. The apparatus as set forth in claim 18 including visually perceivable means for depicting the status of said AC source and said DC source.

20. The apparatus as set forth in claim 19 including visually perceivable means for depicting the elapsed time counted by said timer.

21. The apparatus as set forth in claim 20 including means for resetting said timer.

22. The apparatus as set forth in claim 2 including a second alternative passageway for receiving the rod and wherein said lock block is in the unlatched position to accommodate translation of the rod along said second passageway and wherein said lock block is in the latched position to preclude translation of the rod along said second passageway.

23. A time lock device for a bank vault door having a rectilinearly translating rod, which rod translates as a function of the open and closed position of the vault door, said device comprising in combination:

(a) means for restricting translation of the rod subsequent to closing of the vault door to prevent opening of the vault door;
(b) means for disengaging said restricting means to permit opening of the vault door;
(c) means for urging actuation of said restricting means prior to closing of the vault door;
(d) means for developing a first signal responsive to the passage of time;
(e) means for developing a second signal reflective of the passage of a predetermined time period subsequent to energization of said first signal developing means;
(f) means for comparing the first and second signals and for developing a third signal; and
(g) means responsive to the third signal for actuating said disengaging means.

24. The apparatus as set forth in claim 23 including means for latching said restricting means and wherein said disengaging means includes means for unlatching said restricting means.

25. The apparatus as set forth in claim 24 wherein said unlatching means includes electromechanical means responsive to the third signal for unlatching said restricting means.

26. The apparatus as set forth in claim 25 wherein said electromechanical means comprises first and second solenoids and including means responsive to the third signal for energizing said first solenoid prior to energizing said second solenoid.

27. The apparatus as set forth in claim 26 including means for accelerating operation of said first signal developing means.

28. The apparatus as set forth in claim 24 including means for displaying a time reflective of said first signal.

29. The apparatus as set forth in claim 28 including an AC source and a DC source for providing, in the alternative, electrical power to each of said first signal developing means, said second signal developing means, said third signal developing means, said actuating means and said displaying means and further means for displaying the availability of electrical power from said AC source and said DC source.

30. A method for locking a bank vault door for a preset time period and wherein the vault door includes an axially translatable rod translatable from a first position to a second position and return in response to opening and closing of the vault door, respectively, said method comprising the steps of:

(a) providing a passageway within a body block for receiving the rod and for accommodating translation of the rod from the first position to the second position;
(b) blocking with a lock block disposed in the body block translation of the rod from the second position to the first position to preclude opening of the vault door;
(c) unblocking translation of the rod from the second position to the first position;
(d) said step of blocking including the step of translating the lock block to a latched position;
(e) said step of unblocking including the step of unlatching the lock block and repositioning the lock block in response to the force of gravity to an unlatched position;
(f) generating a train of pulses indicative of passage of time;
(g) counting the pulses in the train of pulses and generating a first output signal indicative of the passage of time;
(h) setting a predetermined period of time by setting at least one generator to generate a second signal reflective of the predetermined time period;
(i) comparing the first signal with the second signal and further generating a third signal reflective of correspondence between the first and second signals; and
(j) producing an output signal in response to the third signal to actuate said step of unlatching and to permit translation of the rod from the second position to the first position within the body block.

31. The method as set forth in claim 30 wherein the body block includes a latch for engaging the lock block and wherein said step of unlatching includes the step of relocating the latch to release the lock block.

32. The method as set forth in claim 31 wherein the body block includes a pair of solenoids in operative engagement with the latch and wherein said step of unlatching includes the step of serially energizing the solenoids.

33. The method as set forth in claim 32 including the step of urging the lock block downwardly to augment the force of gravity.

34. The method as set forth in claim 30 including the step of inhibiting exercise of said producing step in the event of an electrical component failure.

35. The method as set forth in claim 34 including the step of providing a visually perceivable indication of the source of power for the electrical components.

36. The method as set forth in claim 30 wherein said steps of generating, counting, setting and comparing are exercised prior to said step of blocking.

37. The method as set forth in claim 30 including the step of preloading the lock block to encourage exercise of said step of blocking prior to closing of the vault door.

38. The method as set forth in claim 37 wherein said step of preloading initiates exercise of said steps of generating, counting, setting and comparing.

39. The method as set forth in claim 38 including the step of providing one of two mutually exclusive sources of electrical power for energizing said steps of generating, counting, comparing and producing.

40. The method as set forth in claim 30 including the step of accelerating operation of said step of counting.

* * * * *